US006416149B2

(12) United States Patent
Takahashi

(10) Patent No.: US 6,416,149 B2
(45) Date of Patent: Jul. 9, 2002

(54) INK JET APPARATUS, INK JET APPARATUS DRIVING METHOD, AND STORAGE MEDIUM FOR STORING INK JET APPARATUS CONTROL PROGRAM

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/841,997

(22) Filed: Apr. 26, 2001

Related U.S. Application Data

(63) Continuation-in-part of application No. 09/200,986, filed on Nov. 30, 1998, now Pat. No. 6,257,686.

(30) Foreign Application Priority Data

Dec. 16, 1997 (JP) ..... 9-346721
Apr. 26, 2000 (JP) ..... 2000-125583

(51) Int. Cl.[7] ..... B41J 29/38
(52) U.S. Cl. ..... 347/10; 347/9; 347/11
(58) Field of Search ..... 347/9–11, 68

(56) References Cited

U.S. PATENT DOCUMENTS 4,879,568 A 11/1989 Bartky et al. ..... 347/69
4,887,100 A 12/1989 Michaelis et al. ..... 347/69
5,028,936 A 7/1991 Bartky et al. ..... 347/69

FOREIGN PATENT DOCUMENTS

JP 403222750 A * 10/1991 ..... 347/10
JP 405155010 A * 6/1993 ..... 347/11
JP 11-170514 A 6/1999

* cited by examiner

*Primary Examiner*—John Barlow
*Assistant Examiner*—An H. Do
(74) *Attorney, Agent, or Firm*—Oliff & Berridge, PLC

(57) ABSTRACT

Three types of ink droplets, that is, large, medium and small droplets are ejected to produce a gray-scale image, and three drive waveforms are prepared for each of the three types of ink droplets. The drive waveform to print a dot is selected by judging whether there is ink ejection immediately before and/or after the dot to be printed and the type of each droplet ejected immediately before and/or after the dot to be printed. An optimum drive waveform can be selected according to vibrations in the ink channel. Thus, high-quality printing is achieved without partially unstable dots and changes in the ink droplet volume.

20 Claims, 11 Drawing Sheets

Fig. 7

| IMMEDIATELY BEFORE | IMMEDIATELY AFTER | DRIVE WAVEFORM |
|---|---|---|
| LARGE DROPLET | LARGE DROPLET | DRIVE WAVEFORM 1 |
| LARGE DROPLET | MEDIUM DROPLET | DRIVE WAVEFORM 1 |
| LARGE DROPLET | SMALL DROPLET | DRIVE WAVEFORM 1 |
| LARGE DROPLET | NO EJECTION | DRIVE WAVEFORM 2 |
| MEDIUM DROPLET | LARGE DROPLET | DRIVE WAVEFORM 1 |
| MEDIUM DROPLET | MEDIUM DROPLET | DRIVE WAVEFORM 1 |
| MEDIUM DROPLET | SMALL DROPLET | DRIVE WAVEFORM 1 |
| MEDIUM DROPLET | NO EJECTION | DRIVE WAVEFORM 2 |
| SMALL DROPLET | LARGE DROPLET | DRIVE WAVEFORM 1 |
| SMALL DROPLET | MEDIUM DROPLET | DRIVE WAVEFORM 1 |
| SMALL DROPLET | SMALL DROPLET | DRIVE WAVEFORM 1 |
| SMALL DROPLET | NO EJECTION | DRIVE WAVEFORM 2 |
| NO EJECTION | LARGE DROPLET | DRIVE WAVEFORM 3 |
| NO EJECTION | MEDIUM DROPLET | DRIVE WAVEFORM 3 |
| NO EJECTION | SMALL DROPLET | DRIVE WAVEFORM 3 |
| NO EJECTION | NO EJECTION | DRIVE WAVEFORM 3 |

Fig. 8

| IMMEDIATELY BEFORE | IMMEDIATELY AFTER | DRIVE WAVEFORM |
|---|---|---|
| LARGE DROPLET | LARGE DROPLET | DRIVE WAVEFORM 5 |
| LARGE DROPLET | MEDIUM DROPLET | DRIVE WAVEFORM 5 |
| LARGE DROPLET | SMALL DROPLET | DRIVE WAVEFORM 5 |
| LARGE DROPLET | NO EJECTION | DRIVE WAVEFORM 5 |
| MEDIUM DROPLET | LARGE DROPLET | DRIVE WAVEFORM 4 |
| MEDIUM DROPLET | MEDIUM DROPLET | DRIVE WAVEFORM 4 |
| MEDIUM DROPLET | SMALL DROPLET | DRIVE WAVEFORM 4 |
| MEDIUM DROPLET | NO EJECTION | DRIVE WAVEFORM 5 |
| SMALL DROPLET | LARGE DROPLET | DRIVE WAVEFORM 4 |
| SMALL DROPLET | MEDIUM DROPLET | DRIVE WAVEFORM 4 |
| SMALL DROPLET | SMALL DROPLET | DRIVE WAVEFORM 4 |
| SMALL DROPLET | NO EJECTION | DRIVE WAVEFORM 5 |
| NO EJECTION | LARGE DROPLET | DRIVE WAVEFORM 6 |
| NO EJECTION | MEDIUM DROPLET | DRIVE WAVEFORM 6 |
| NO EJECTION | SMALL DROPLET | DRIVE WAVEFORM 6 |
| NO EJECTION | NO EJECTION | DRIVE WAVEFORM 6 |

Fig. 9

| IMMEDIATELY BEFORE | IMMEDIATELY AFTER | DRIVE WAVEFORM |
|---|---|---|
| LARGE DROPLET | LARGE DROPLET | DRIVE WAVEFORM 8 |
| LARGE DROPLET | MEDIUM DROPLET | DRIVE WAVEFORM 8 |
| LARGE DROPLET | SMALL DROPLET | DRIVE WAVEFORM 8 |
| LARGE DROPLET | NO EJECTION | DRIVE WAVEFORM 8 |
| MEDIUM DROPLET | LARGE DROPLET | DRIVE WAVEFORM 8 |
| MEDIUM DROPLET | MEDIUM DROPLET | DRIVE WAVEFORM 8 |
| MEDIUM DROPLET | SMALL DROPLET | DRIVE WAVEFORM 8 |
| MEDIUM DROPLET | NO EJECTION | DRIVE WAVEFORM 8 |
| SMALL DROPLET | LARGE DROPLET | DRIVE WAVEFORM 7 |
| SMALL DROPLET | MEDIUM DROPLET | DRIVE WAVEFORM 7 |
| SMALL DROPLET | SMALL DROPLET | DRIVE WAVEFORM 7 |
| SMALL DROPLET | NO EJECTION | DRIVE WAVEFORM 8 |
| NO EJECTION | LARGE DROPLET | DRIVE WAVEFORM 9 |
| NO EJECTION | MEDIUM DROPLET | DRIVE WAVEFORM 9 |
| NO EJECTION | SMALL DROPLET | DRIVE WAVEFORM 9 |
| NO EJECTION | NO EJECTION | DRIVE WAVEFORM 9 |

Fig. 10

| IMMEDIATELY BEFORE | IMMEDIATELY AFTER | DRIVE WAVEFORM |
|---|---|---|
| LARGE DROPLET | LARGE DROPLET | NO EJECTION |
| LARGE DROPLET | MEDIUM DROPLET | NO EJECTION |
| LARGE DROPLET | SMALL DROPLET | NO EJECTION |
| LARGE DROPLET | NO EJECTION | NO EJECTION |
| MEDIUM DROPLET | LARGE DROPLET | NO EJECTION |
| MEDIUM DROPLET | MEDIUM DROPLET | NO EJECTION |
| MEDIUM DROPLET | SMALL DROPLET | NO EJECTION |
| MEDIUM DROPLET | NO EJECTION | NO EJECTION |
| SMALL DROPLET | LARGE DROPLET | NO EJECTION |
| SMALL DROPLET | MEDIUM DROPLET | NO EJECTION |
| SMALL DROPLET | SMALL DROPLET | NO EJECTION |
| SMALL DROPLET | NO EJECTION | NO EJECTION |
| NO EJECTION | LARGE DROPLET | NO EJECTION |
| NO EJECTION | MEDIUM DROPLET | NO EJECTION |
| NO EJECTION | SMALL DROPLET | NO EJECTION |
| NO EJECTION | NO EJECTION | NO EJECTION |

INK JET APPARATUS, INK JET APPARATUS DRIVING METHOD, AND STORAGE MEDIUM FOR STORING INK JET APPARATUS CONTROL PROGRAM

This application is a continuation-in-part of Serial No. 09/200,986 filed on Nov. 30, 1998 now U.S. Pat. No. 6,257,686, which issued Jul. 10, 2001, the disclosure of which is incorporated by reference herein.

BACKGROUND OF THE INVENTION

1. Field of Invention

The invention relates to an ink jet apparatus, an ink jet apparatus driving method, and a storage medium for storing an ink jet apparatus control program.

2. Description of Related Art

In conventional ink jet apparatuses, the volumetric capacity of an ink channel is changed by deformation of piezoelectric ceramic. When the volumetric capacity is reduced, ink in the ink channel is ejected as an ink droplet from a nozzle and, when the volumetric capacity is increased, ink flows into the ink channel from an ink guide port. In a printhead for this kind of ink jet apparatus, a plurality of ink channels are formed and separated by piezoelectric ceramic sidewalls. An ink supplying means, such as an ink cartridge, is connected to one end of each ink channel, and an ink ejection nozzle (hereinafter referred to as a nozzle) is provided for the other end of each ink channel. Selective reductions of the volumetric capacity of the ink channels by deformation of the sidewalls, according to print data, cause ink droplets to be ejected from the corresponding nozzles onto a print medium and, as a result, characters and graphics are printed thereon.

Ink jet apparatuses of this kind, i.e., drop-on-demand type ink jet heads, which eject ink droplets for printing, are becoming widespread because of their excellent ejection efficiency and low running costs.

A problem with such conventional ink jet heads is that vibrations remaining in the ink channel after ink droplet ejection in response to a print command will affect ink droplet ejection in response to the next print command. As a result, the ink droplet trajectory may be curved or the ink droplet volume may be changed.

In recent years, the volume of an ink droplet to be ejected is variably adjusted to produce a gray-scale image. In this case, accurate ejection of a required volume of an ink droplet is critical to ensure high print quality. Printing at high speed, that is, dot forming at high frequencies, is susceptible to the residual vibrations in the ink channel and may result in changes in the ink droplet ejection volume and production of a poor gray-scale image.

Conventionally, adjustment of the ink droplet volume for printing a dot has been attempted by judging whether there is ink ejection immediately before a dot to be printed and by changing the voltage for ejecting ink to print the dot. However, because the residual vibrations vary depending on the previously ejected ink droplet volume, it has been difficult to adjust the ink droplet volume for printing a dot as required in a stable manner.

SUMMARY OF THE INVENTION

In view of the foregoing problems, the invention provides an ink jet apparatus and a driving method thereof that ensure stable ejection of a desired volume of an ink droplet for high-quality printing. A drive waveform for printing a dot is adjusted according to the presence or absence of an ejection pulse signal immediately before and/or after the dot to be printed and according to the waveform of each ejection pulse signal present immediately before and/or after the dot to be printed.

According to one aspect of the invention, a method of driving an ink jet apparatus is provided. The ink jet apparatus includes a nozzle from which an ink droplet is ejected, an ink channel filled with ink and connected to the nozzle, an actuator that changes a volumetric capacity of the ink channel to generate a pressure wave in the ink channel, and a controller that applies an ejection pulse signal to the actuator to cause ink droplet ejection from the nozzle. In the ink jet apparatus driving method, whether an ejection pulse signal is present at least immediately before or after a dot to be formed is judged and, if so, a drive waveform of the ejection pulse signal present at least immediately before or after the dot to be formed is judged. Then, based on results of the judgement, a drive waveform of an ejection pulse signal for forming the dot is adjusted.

In this method, a required volume of an ink droplet for forming a dot can be stably ejected, according to the condition of an ink meniscus in the nozzle and the residual vibrations in the ink channel, by judging whether there is ink ejection immediately before and/or after the dot to be formed and judging the drive waveform used for each ink ejection present immediately before and/or after the dot to be formed.

In this ink jet apparatus driving method, a plurality of drive waveforms are previously prepared as ejection pulse signals to be applied to the actuator and, the drive waveform for forming the dot is adjusted by selecting one of the plurality of drive waveforms, based on the results of the judgement. Accordingly, in this method, an optimum drive waveform for forming a dot can be selected according to the condition of an ink meniscus in the nozzle and the residual vibrations in the ink channel at the time of forming the dot.

Further, in this ink jet apparatus driving method, the ejection pulse signals are classified into groups by ink droplet ejection volume, and each group includes a plurality of ejection pulse signals having different drive waveforms. A drive waveform for forming a dot is adjusted by selecting an ejection pulse signal having a predetermined drive waveform from among a plurality of ejection pulse signals that are classified under a group designated for the dot to be formed.

In this method, an optimum drive waveform for forming a dot can be selected according to the condition of an ink meniscus in the nozzle and the residual vibrations in the ink channel and, as a result, a high-quality continuous gray-scale image can be produced.

According to another aspect of the invention, an ink jet apparatus to accomplish the above-described method is provided.

According to still another aspect of the invention, a storage medium for storing a program that accomplishes the above-described method is provided. The program in the storage medium is loaded into a personal computer, or the like, from which print data is outputted to an ink jet apparatus to perform printing.

BRIEF DESCRIPTION OF THE DRAWINGS

A preferred embodiment of the invention will be described with reference to the following figures wherein:

FIG. 7 is a table showing conditions for selecting the drive waveform for driving the ink jet apparatus to eject a large droplet, according to the embodiment of the invention;

FIG. 8 is a table showing conditions for selecting the drive waveform for driving the ink jet apparatus to eject a medium droplet, according to the embodiment of the invention;

FIG. 9 is a table showing conditions for selecting the drive waveform for driving the ink jet apparatus to eject a small droplet, according to the embodiment of the invention;

FIG. 10 is a table showing conditions for selecting the drive waveform when the ink jet apparatus ejects no ink;

DETAILED DESCRIPTION OF PREFERRED EMBODIMENTS

Figure 1:
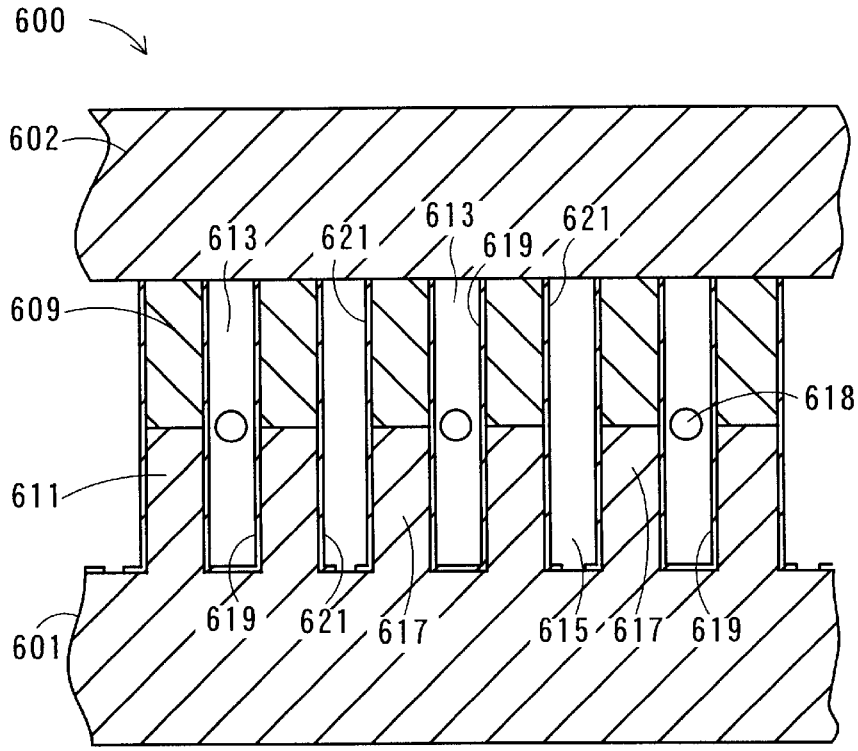
FIG. 1 is a sectional view of an ink jet head of an ink jet apparatus according to an embodiment of the invention.
Figure 2:
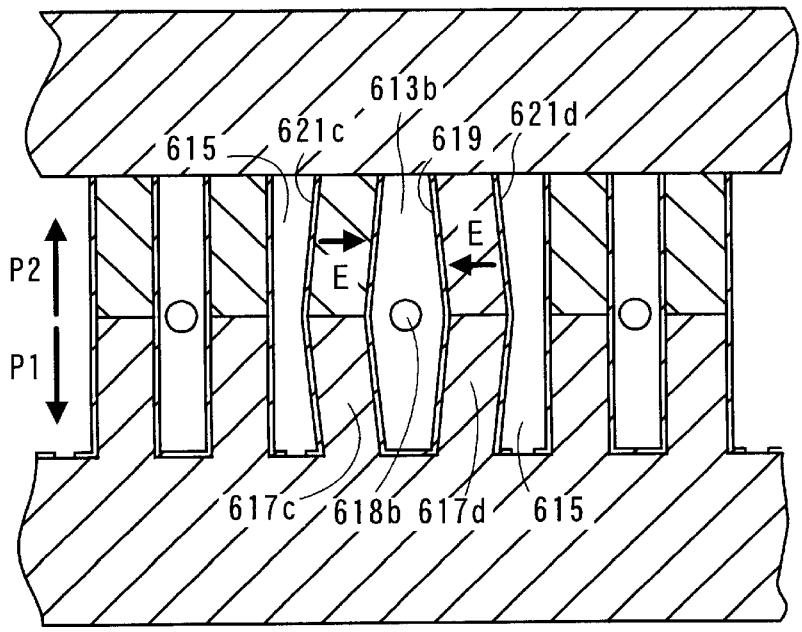
FIG. 2 illustrates actions of the ink jet head of the ink jet apparatus according to the embodiment of the invention.
Figure 3:
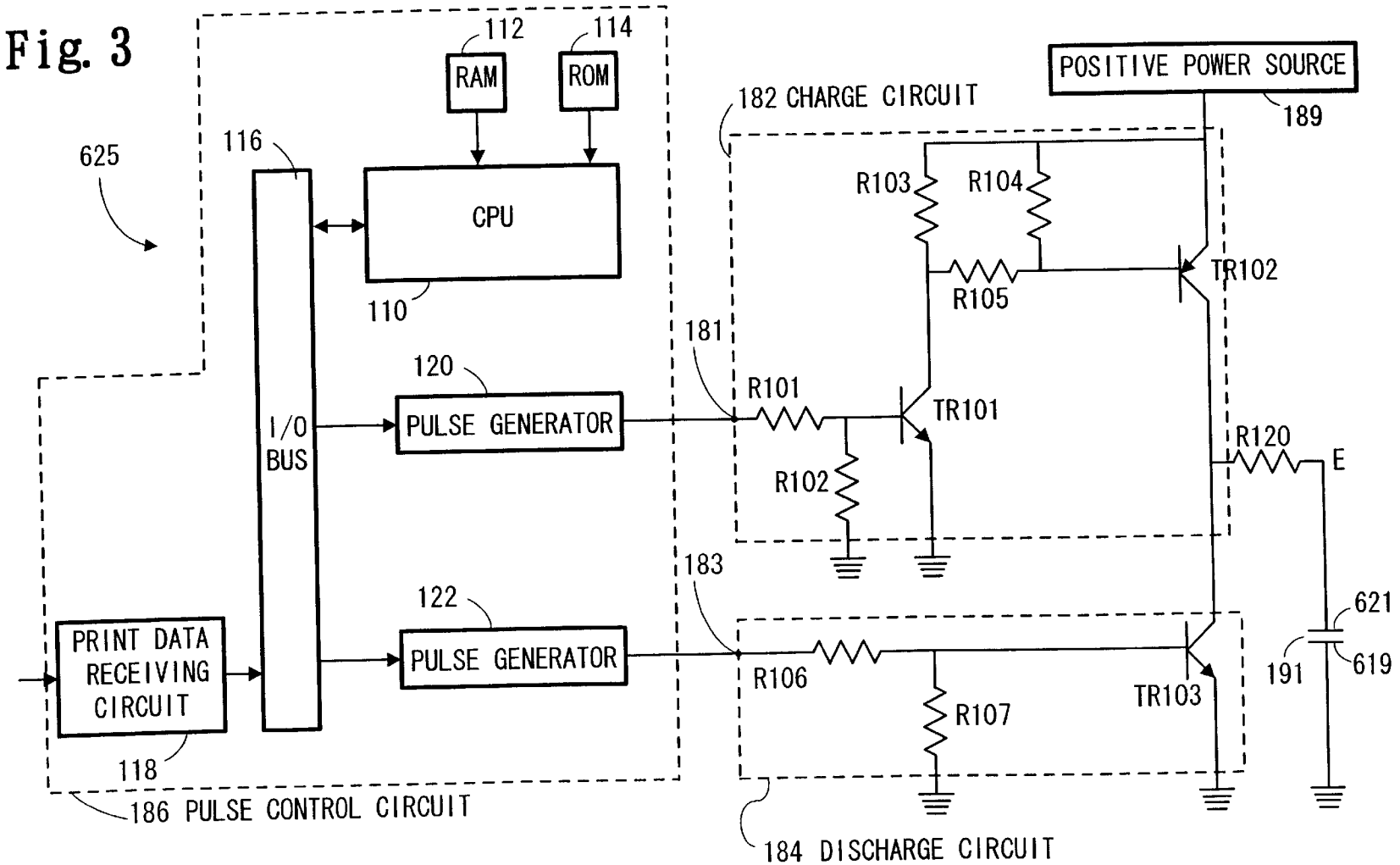
FIG. 3 shows a control circuit of the ink jet apparatus according to the embodiment of the invention.

One embodiment of the invention will be described with reference to the attached drawings. Referring first to FIGS. 1 through 3, the basic structure of an ink jet apparatus according to one embodiment of the invention will be described.

As a drop-on-demand type ink jet head, a shear mode type utilizing piezoelectric ceramic is disclosed in U.S. Pat. Nos. 4,879,568, 4,887,100, and 5,028,936, and U.S. Pat. No. 6,257,686, issued Jul. 10, 2001, all of which are incorporated herein by reference.

FIG. 1 shows a sectional view of an exemplary shear mode type ink jet head. An ink jet head 600 includes an actuator substrate 601 and a cover plate 602. Formed in the actuator substrate 601 are a plurality of ink channels 613, each shaped like a narrow groove and extending perpendicularly to the sheet of FIG. 1, and a plurality of dummy channels 615 carrying no ink. The ink channels 613 and the dummy channels 615 are isolated by sidewalls 617. Each sidewall 617 is divided into upper and lower halves, that is, an upper wall 609 polarized in direction P2 and a lower wall 611 polarized in direction P1. A nozzle 618 is provided at one end of each ink channel 613, and a manifold for supplying ink is provided at the other end thereof. Each dummy channel 615 is closed at the manifold-side end to block the entry of ink. Electrodes 619, 621 are provided, as metalized layers, on opposite side surfaces of each sidewall 617. More specifically, an electrode 619 in the ink channel 613 is disposed along the sidewall surfaces defining the ink channel 613. All electrodes 619 provided in the ink channels 613 are grounded. An electrode 621 in the dummy channel 615 is disposed on each of the sidewall surfaces defining the dummy channel 615. Two adjacent electrodes 621 provided in each dummy channel 615 are insulated from each other. Two adjacent dummy channel electrodes 621 disposed on sidewalls 617 opposite from an interposed ink channel 613 are electrically connected with each other, and also connected to a controller 625 (FIG. 3), which generates actuator driving signals.

When the controller 625 (FIG. 3) applies a voltage to two adjacent dummy channel electrodes 621 disposed on sidewalls 617 opposite from an interposed ink channel 613, the upper and lower walls 609, 611 of the two adjacent sidewalls 617 deform, by a piezoelectric shearing effect, in such directions that the volumetric capacity of the interposed ink channel 613 increases. For example, as shown in FIG. 2, when an ink channel 613*b* is driven, a voltage of E V is applied to two adjacent dummy channel electrodes 621*c*, 621*d*, disposed opposite from the interposed ink channel 613*b*, while all electrodes 619 in the ink channels are grounded. Consequently, electric fields are generated on sidewalls 617*c*, 617*d* in the directions of arrows E, and the upper and lower walls of the sidewalls 617*c*, 671*d* deform, by a piezoelectric shearing effect, in such directions that the volumetric capacity of the ink channel 613*b* is increased. At this time, the pressure within the ink channel 613*b*, including in the vicinity of the nozzle 618*b*, is reduced. By maintaining such a state for a period of time T required for one-way propagation of a pressure wave along the ink channel 613*b*, ink is supplied from the manifold (not shown) for that period of time.

The one-way propagation time T represents a time required for a pressure wave in the ink channel 613*b* to propagate longitudinally along the ink channel 613*b*, and is given by an expression T=L/Z, where L is a length of the ink channel 613*b*, and Z is a speed of sound in the ink in the ink channel 613*b*.

According to the theory of propagation of a pressure wave, when the time T has expired after the application of a voltage of E V, the pressure in the ink channel 613*b* is reversed to a positive pressure. Concurrently with the reversing of the pressure, the voltage applied to the electrodes 621*c*, 621*d* are reset to 0 V.

Then, the sidewalls 617*c*, 617*d* return to their original states (FIG. 1), and pressurize the ink. At this time, the pressure reversed to a positive pressure is combined with the pressure generated upon returning of the sidewalls 617*c*, 617*d*, and a relatively high pressure is generated in the vicinity of the nozzle 618*b* of the ink channel 613*b*. As a result, an ink droplet is ejected from the nozzle 618*b*.

More specifically, if a time period between applying a voltage of E V and resetting the voltage to 0 V does not agree with the one-way propagation time T, energy efficiency for ink droplet ejection decreases. Particularly, when the time period between applying and resetting the voltage is even multiples of the one-way propagation time T, no ink is ejected. When high energy efficiency is desired, for example, when driving at a voltage as low as possible is desired, it is preferable that the time period between applying and resetting the voltage is equal to the one-way propagation time T, or at least odd multiples of the one-way propagation time T.

Specific dimensions of the ink jet head 600 will be shown by way of example. The ink channel is 6.0 mm in length (L). The nozzle 618 is 26 $\mu$m in diameter on the ink ejecting side, 40 $\mu$m in diameter on the ink channel side, and 75 $\mu$m in length. When the temperature is 25° C., the viscosity of the ink used for an experiment is approximately 2 mPa-s and the surface tension thereof is 30 mN/m at 25° C. The ratio L/Z (=T) of the sound speed Z in the ink in the ink channel 613 to the ink channel length L is 9.0 $\mu$sec.

According to the embodiment of the invention, an ink jet head 600 that is driven to produce four levels of gray will be described. More specifically, the ink jet head 600 is driven to eject a large droplet of 60 pl (picoliters) in volume, a medium droplet of 30 pl, and a small droplet of 15 pl, or to eject no ink.

A drive waveform applied to adjacent electrodes 621 provided in dummy channels 615, which sandwich an ink channel 613, is selected from among previously prepared three drive waveforms based on whether there is ink ejection immediately before and/or after a dot to be printed, that is, whether an adjacent dot is printed immediately before and/or after a dot to be printed, and based on the drive waveform used for each ink ejection present immediately before and/or after the dot to be printed.

FIGS. 4A through 6C and FIGS. 7 through 10 show ejection pulse signals for various volumes of ink droplets and whether they are to be ejected during continuous printing, following a dot to be precedingly printed or before a following dot. Although the following description is in terms of a drive waveform for an ejection pulse signal, in the case of a dot immediately following a dot to be printed, the ejection pulse signal has not yet been fixed. However, there are three predetermined types of drive waveforms which correspond to each volume of ink droplet. Thus, the adjustment of the drive waveform based on the result of judging the volume of the ink droplet, i.e., its size, in the case of a following dot is technically more correct than is the description of judging on the basis of a drive waveform. However, the discussion is stated in terms of drive waveform for consistency.

Further, it is possible to temporarily assign a predetermined drive waveform to a dot that is to be printed immediately after the dot to be currently printed based on the volume of ink droplet corresponding to the next dot to be printed. In such a case, the drive waveform forming the current dot could be adjusted based upon a judgement result of a drive waveform adjusted for the dot to be precedingly printed and a temporarily assigned drive waveform for the next dot to be printed, that is the dot to be printed immediately after the current dot.

Figures 4A, 4B, 4C:
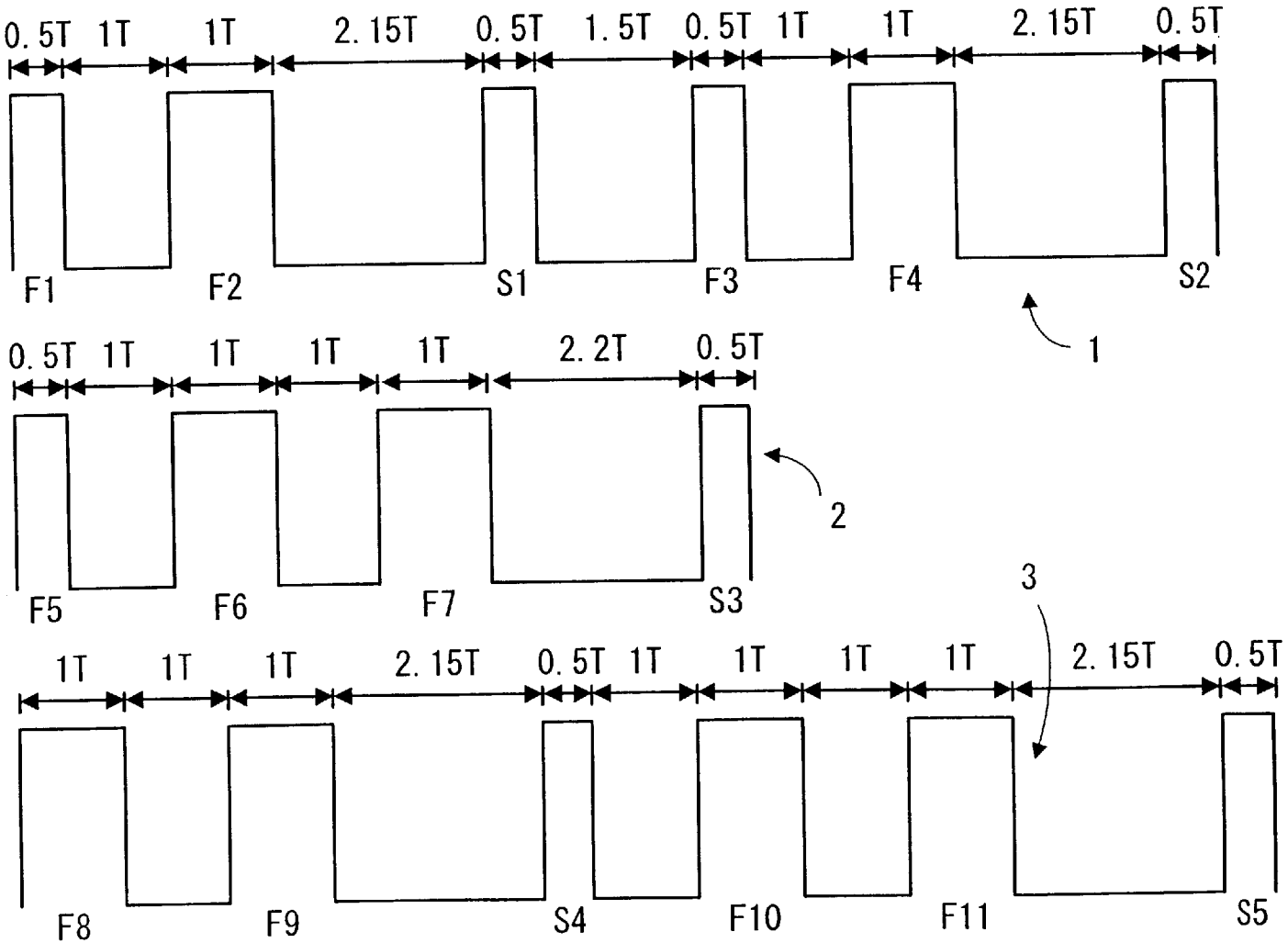
FIGS. 4A through 4C show three drive waveforms for driving the ink jet apparatus to eject a large droplet, according to the embodiment of the invention.

FIGS. 4A through 4C show three ejection pulse signals, each having a different drive waveform for ejecting a large droplet (60 pl). Drive waveform 1, shown in FIG. 4A, is a drive waveform for ejecting a large droplet (60 pl) in a normal state in which the large droplet is continuously ejected. Each numeric value added to the drive waveform indicates the ratio of a given period of time to the one-way propagation time T.

Drive waveform 1, applied in response to a dot print command, includes ejection pulses F1, F2, F3, and F4 for ejecting four ink droplets and two ejection stabilizing pulses S1 and S2 for reducing residual pressure wave vibrations in the ink channel 613. Crest values (voltage values) of all these pulses are E V (for example, 16 V at 25° C.). An ejection stabilizing pulse is applied, at the time when the pressure generated by an ejection pulse increases in the ink channel 613, to enlarge the ink channel 613 and reduce the pressure therein. Another ejection pulse is applied, at the time when the pressure in the ink channel 613 decreases, to reduce the volumetric capacity of the ink channel 613 and increase the pressure therein.

The width of ejection pulse F1 equals 0.5 times the one-way propagation time T of a pressure wave in the ink channel 613, that is, 4.5 μsec. Ejection pulse F1 is applied without a waiting time after the start of a dot printing timed sequence. The width of ejection pulse F2 is the same as the one-way pressure wave propagation time T, that is, 9.0 μsec. A period of time between ejection pulses F1, F2 is the same as the one-way pressure wave propagation time T, that is, 9.0 μsec. The width of ejection stabilizing pulse S1 equals 0.5 times the one-way pressure wave propagation time T, that is, 4.5 μsec. A period of time between ejection pulse F2 and ejection stabilizing pulse S1 equals 2.15 times the one-way pressure wave propagation time T, that is, 19.35 μsec. A period of time between ejection stabilizing pulse S1 and ejection pulse F3 equals 1.5 times the one-way pressure wave propagation time T, that is, 13.5 μsec.

The width of ejection pulse F3 equals 0.5 times the one-way pressure wave propagation time T, that is, 4.5 μsec. The width of ejection pulse F4 equals the one-way pressure wave propagation time T, that is, 9.0 μsec. A period of time between ejection pulses F3, F4 equals the one-way pressure wave propagation time T, that is, 9.0 μsec. The width of ejection stabilizing pulse S2 equals 0.5 times the one-way pressure wave propagation time T, that is, 4.5 μsec. A period of time between ejection pulse F4 and ejection stabilizing pulse S2 equals 2.15 times the one-way pressure wave propagation time T, that is, 19.35 μsec.

The ink droplet volume and ejection stability can be controlled using the above-described pulse applying timing and pulse widths. In the case of drive waveform 1 of FIG. 4A, two ink droplets are continuously ejected and then an ejection stabilizing pulse is applied to suppress the residual pressure wave vibrations in the ink channel 613. After that, two ink droplets are ejected continuously and then an ejection stabilizing pulse is applied to suppress the vibrations in the ink. Four ink droplets are ejected in total in response to a dot print command and coalesce into one dot on a print medium. The dot contains 60 pl of ink for a large ink droplet as required.

The above-described pulse applying timing and pulse widths were obtained from the results of an experiment to ensure stable splash-free ink ejection when dots are printed continuously at temperatures from 5 to 45° C. and at dot printing frequencies from 5 to 8.5 kHz.

Drive waveform 2, shown in FIG. 4B, is used to print a dot when there is no immediately following dot so as to suppress the residual pressure wave vibrations and prevent unwanted ink ejection. The resultant ink droplet ejection volume becomes slightly smaller but not as small as a medium droplet (30 pl), and thus the overall print quality will not be affected.

Drive waveform 2, applied in response to a dot print command, includes ejection pulses F5, F6, and F7 for ejecting three ink droplets and an ejection stabilizing pulse S3 for reducing residual pressure wave vibrations in the ink channel 613. Crest values (voltage values) of all these pulses are E V (for example, 16 V at 25° C.). The width of ejection pulse F5 equals 0.5 times the one-way propagation time T of a pressure wave in the ink channel 613, that is, 4.5 μsec. Ejection pulse F5 is applied without a waiting time after the start of a dot printing timed sequence. The width of each of the ejection pulses F6, F7 equals the one-way pressure wave propagation time T, that is, 9.0 μsec. A period of time between ejection pulses F5 and F6, and a period of time between ejection pulses F6 and F7 equal the one-way pressure wave propagation time T, that is, 9.0 μsec. The width of ejection stabilizing pulse S3 equals 0.5 times the one-way pressure wave propagation time T, that is, 4.5 μsec. A period of time between ejection pulse F7 and ejection stabilizing pulse S3 equals 2.20 times the one-way pressure wave propagation time T, that is, 19.80 μsec.

The ink droplet volume and ejection stability can be controlled using the above-described pulse applying timing and pulse widths. In the case of drive waveform 2, three ink droplets are continuously ejected and then an ejection stabilizing pulse is applied to suppress the residual pressure wave vibrations in the ink channel 613. Three ink droplets are ejected in total in response to a dot print command and coalesce into one dot on a print medium. Because the number of ink droplets is fewer by one than in the case of drive waveform 1, the ink droplet ejection volume is slightly smaller than 60 pl. However, drive waveform 2 can suppress the pressure wave vibrations remaining after ink ejection and, if used to print a dot when there is no immediately following dot, can prevent unwanted ink ejection. The above-described pulse applying timing and pulse widths were obtained from the results of an experiment to ensure stable splash-free ink ejection at temperatures from 5 to 45° C. and at dot printing frequencies from 5 to 8.5 kHz.

Drive waveform 3, shown in FIG. 4C, is designed to make the ink droplet ejection volume slightly greater than in the case of drive waveform 1. If drive waveform 3 is used when the ink droplet ejection volume will be reduced due to the condition of the residual pressure wave vibrations in the ink channel 613, the resultant ink droplet ejection volume can be adjusted to about 60 pl. If drive waveform 3 is used to print a dot continuously from the preceding dot, the residual pressure wave vibrations in the ink channel 613 become greater than in the case of drive waveform 1 and, as a result, the ink droplet ejection volume becomes slightly greater. Thus, drive waveform 3 should be used to print a dot when there is no immediately preceding dot.

Drive waveform 3, applied in response to a dot print command, includes ejection pulses F8, F9, F10, and F11 for ejecting four ink droplets and ejection stabilizing pulses S4 and S5 for reducing the residual pressure wave vibrations in the ink channel 613. Crest values (voltage values) of all these pulses are E V (for example, 16 V at 25° C.). The width of ejection pulse F8 equals the one-way pressure wave propagation time T, that is, 9.0 μsec. Ejection pulse F8 is applied without a waiting time after the start of a dot printing timed sequence. The width of ejection pulse F9 equals the one-way pressure wave propagation time T, that is, 9.0 μsec. The period of time between ejection pulses F8, F9 equals the one-way pressure wave propagation time T, that is, 9.0 μsec. The width of ejection stabilizing pulse S4 equals 0.5 times the one-way pressure wave propagation time T, that is, 4.5 μsec. The period of time between ejection pulse F9 and ejection stabilizing pulse S4 equals 2.15 times the one-way pressure wave propagation time T, that is, 19.35 μsec. A period of time between ejection stabilizing pulse S4 and ejection pulse F10 equals the one-way pressure wave propagation time T, that is, 9.0 μsec. The width of ejection pulse F10 equals the one-way pressure wave propagation time T, that is, 9.0 μsec. The width of ejection pulse F11 equals the one-way pressure wave propagation time T, that is, 9.0 μsec. A period of time between ejection pulses F10, F11 equals the one-way pressure wave propagation time T, that is, 9.0 μsec. The width of ejection stabilizing pulse S5 equals 0.5 times the one-way pressure wave propagation time T, that is, 4.5 μsec. The period of time between ejection pulse F11 and ejection stabilizing pulse S5 equals 2.15 times the one-way pressure wave propagation time T, that is, 19.35 μsec.

The ink droplet volume and ejection stability can be controlled using the above-described pulse applying timing and pulse widths. In the case of drive waveform 3, two ink droplets are continuously ejected and then an ejection stabilizing pulse is applied to suppress the residual pressure wave vibrations in the ink channel 613. After that, two ink droplets are continuously ejected and then an ejection stabilizing pulse is applied to suppress the residual pressure wave vibrations in the ink channel 613. Four ink droplets are ejected in total in response to a dot print command and coalesce into one dot on a print medium. The ejection pulse widths and the pulse applying timing are adjusted differently from drive waveform 1. Accordingly, if drive waveform 3 were used to print a dot continuously from the preceding dot, the ink droplet ejection volume becomes slightly greater than 60 pl. However, when drive waveform 3 is used to print a dot when the residual pressure wave vibrations in the ink channel 613 are so limited that the ink ejection volume will be reduced, the ink droplet ejection volume can be adjusted to 60 pl, as required. Thus, drive waveform 3 is used when there is no immediately preceding dot. The above pulse applying timing and pulse widths were obtained from the results of an experiment to ensure stable splash-free ink ejection at temperatures from 5 to 45° C. and at dot printing frequencies from 5 to 8.5 kHz.

Figures 5A, 5B, 5C:
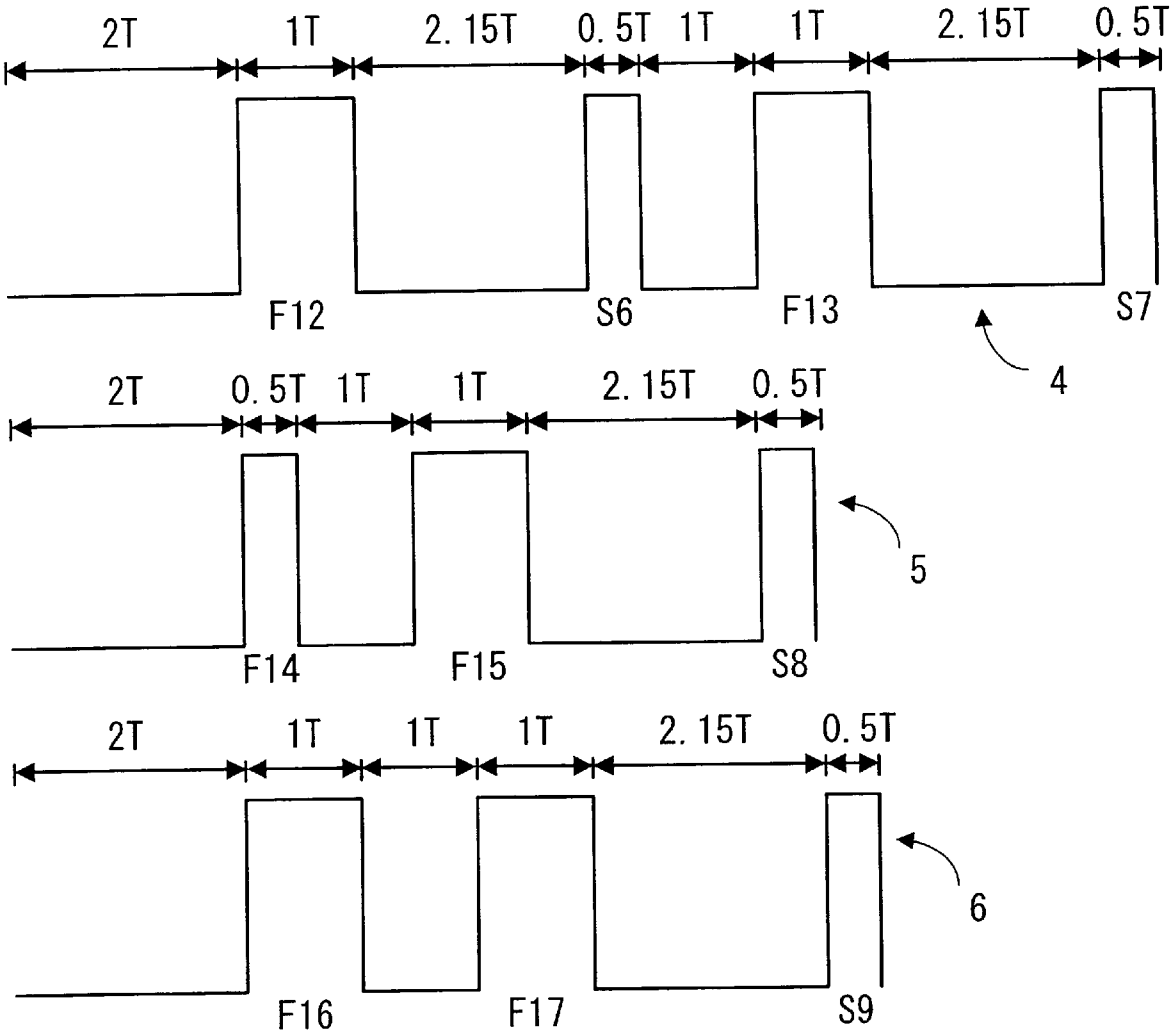
FIGS. 5A through 5C show three drive waveforms for driving the ink jet apparatus to eject a medium droplet, according to the embodiment of the invention.

FIGS. 5A through 5C show three ejection pulse signals, each having a different drive waveform for ejecting a medium droplet (30 pl). Drive waveform 4, shown in FIG. 5A, is a drive waveform for ejecting a medium droplet (30 pl) in a normal printing state in which the medium droplet is continuously ejected. Each numeric value added to the drive waveform indicates the ratio of a period of time to the one-way propagation time T.

Drive waveform 4, applied in response to a dot print command, includes ejection pulses F12, F13 for ejecting two ink droplets and ejection stabilizing pulses S6, S7 for reducing the residual pressure wave vibrations in the ink channel 613. Crest values (voltage values) of all these pulses are E V (for example, 16 V at 25° C.). The width of ejection pulse F12 equals the one-way pressure wave propagation time T, that is, 9.0 μsec. In order to reduce the influence of the residual pressure wave vibrations in the ink channel 613 generated by printing the immediately preceding dot, application of ejection pulse F12 is delayed after the start of a dot printing timed sequence for 2.0 times the one-way pressure wave propagation time T, that is, 18.0 μsec. The width of ejection stabilizing pulse S6 equals 0.5 times the one-way pressure wave propagation time T, that is, 4.5 μsec. A period of time between ejection pulse F12 and ejection stabilizing pulse S6 equals 2.15 times the one-way pressure wave propagation time T, that is, 19.35 μsec. A period of time between the ejection stabilizing pulse S6 and ejection pulse F13 equals the one-way pressure wave propagation time T, that is, 9.0 μsec. The width of ejection pulse F13 equals the one-way pressure wave propagation time T, that is, 9.0 μsec and the width of ejection stabilizing pulse S7 equals 0.5 times the one-way pressure wave propagation time T, that is, 4.5 μsec. The period of time between ejection pulse F13 and ejection stabilizing pulse S7 equals 2.15 times the one-way pressure wave propagation time T, that is, 19.35 μsec.

The ink droplet volume and ejection stability can be controlled using the above-described pulse applying timing and pulse widths. In the case of drive waveform 4 of FIG. 5A, an ink droplet is ejected and then an ejection stabilizing pulse is applied to suppress the residual pressure wave vibrations in the ink channel 613. After that, another ink droplet is ejected and then a second ejection stabilizing pulse is applied to suppress the vibrations in the ink near the nozzle 618. Two ink droplets are ejected in total in response to a dot print command and coalesce into one dot on a print medium. The dot contains 30 pl of ink droplets as required. The above pulse applying timing and pulse widths were obtained from the results of an experiment to ensure stable splash-free ink ejection when dots are printed continuously at temperatures from 5 to 45° C. and at dot printing frequencies from 5 to 8.5 kHz.

Drive waveform 5, shown in FIG. 5B, is designed to make the ink droplet ejection volume slightly smaller than in the case of drive waveform 4. If drive waveform 5 is used to print a dot when the residual pressure wave vibrations in the ink channel 613 are so great that the ink ejection volume will be increased, the resultant ink droplet ejection volume can be adjusted to about 30 pl. Drive waveform makes the ink ejection droplet volume smaller and, as a result, makes the residual pressure wave vibrations in the ink channel 613 smaller than in the case of drive waveform 4. Thus, if there were ink ejection immediately after a dot is printed using waveform 5, the ejection is less likely to be affected because the ink ejection volume is smaller and residual pressure wave vibrations in the ink channel 613 are smaller that in the case of drive waveform 4.

Drive waveform 5, applied in response to a dot print command, includes ejection pulses F14 and F15 for ejecting two ink droplets and an ejection stabilizing pulse S8 for reducing the residual pressure wave vibrations in the ink channel 613. Crest values (voltage values) of all these pulses are E V (for example, 16 V at 25° C.). The width of ejection pulse F14 equals 0.5 times the one-way pressure wave propagation time T, that is, 4.5 μsec. In order to reduce the influence of the residual pressure wave vibrations in the ink channel 613 generated by printing the immediately preceding dot, application of ejection pulse F14 is delayed after the start of a dot printing timed sequence for 2.0 times the one-way pressure wave propagation time T, that is, 18.0 μsec. The width of ejection pulse F15 equals the one-way pressure wave propagation time T, that is, 9.0 μsec. A period of time between ejection pulses F14 and F15 equals the one-way pressure wave propagation time T, that is, 9.0 μsec. The width of ejection stabilizing pulse S8 equals 0.5 times the one-way pressure wave propagation time T, that is, 4.5 μsec. A period of time between ejection pulse F15 and ejection stabilizing pulse S8 equals 2.15 times the one-way pressure wave propagation time T, that is, 19.35 μsec.

The ink droplet volume and ejection stability can be controlled using the above-described pulse applying timing and pulse widths. In the case of drive waveform 5 of FIG. 5B, two ink droplets are continuously ejected and then an ejection stabilizing pulse is applied to suppress the residual pressure wave vibrations in the ink channel 613. Two ink droplets are ejected in total in response to a dot print command and coalesce into one dot on a print medium. Because the ejection pulse widths and the pulse applying timing are adjusted differently from drive waveform 4, the ink droplet ejection volume becomes slightly smaller than 30 pl. Therefore, drive waveform 5 can suppress the pressure wave vibrations remaining after ink ejection, and if used to print a dot when there is no immediately following dot, can prevent unwanted ink ejection. However, if drive waveform 5 is used to print a dot when the residual pressure wave vibrations in the ink channel 613 are so great that the ink droplet ejection volume will be increased, the ink droplet ejection volume can be adjusted to 30 pl, as required. The above pulse applying timing and pulse widths were obtained from the results of an experiment to ensure stable splash-free ink ejection at temperatures from 5 to 45° C. and at dot printing frequencies from 5 to 8.5 kHz.

Drive waveform 6, shown in FIG. 5C, is designed to make the ink droplet ejection volume slightly greater than in the case of drive waveform 4. If drive waveform 6 is used to print a dot when the residual pressure wave vibrations in the ink channel 613 are so small that the ink ejection volume will be reduced, the resultant ink droplet ejection volume can be adjusted to about 30 pl. Should drive waveform 6 be used to print a dot continuously from the preceding dot, the residual pressure wave vibrations in the ink channel 613 become greater than in the case of drive waveform 4 and, as a result, the ink droplet ejection volume becomes slightly greater. Thus, drive waveform 6 should be used to print a dot when there is no immediately preceding dot.

Drive waveform 6, applied in response to a dot print command, includes ejection pulses F16, F17 for ejecting two ink droplets and an ejection stabilizing pulse S9 for reducing the residual pressure wave vibrations in the ink channel 613. Crest values (voltage values) of all these pulses are E V (for example, 16 V at 25° C.). The width of ejection pulse F16 equals the one-way pressure wave propagation time T, that is, 9.0 μsec. In order to reduce the influence of the residual pressure wave vibrations in the ink channel 613 that may exist from previous dot printing timed sequences, i.e., for the preceding dot printing timed sequences even though no dot was printed in the immediately preceding dot printing timed sequence, application of ejection pulse F16 is delayed after the start of a dot printing timed sequence for 2.0 times the one-way pressure wave propagation time T, that is, 18.0 μsec. The width of ejection pulse F17 equals the one-way pressure wave propagation time T, that is, 9.0 μsec. A period of time between ejection pulses F16, F17 equals the one-way pressure wave propagation time T, that is, 9.0 μsec and the width of ejection stabilizing pulse S9 equals 0.5 times the one-way pressure wave propagation time T, that is, 4.5 μsec. A period of time between ejection pulse F17 and ejection stabilizing pulse S9 equals 2.15 times the one-way pressure wave propagation time T, that is, 19.35 μsec.

The ink droplet volume and ejection stability can be controlled using the above-described pulse applying timing and pulse widths. In the case of drive waveform 6 of FIG. 5C, two ink droplets are continuously ejected and then an ejection stabilizing pulse is applied to suppress the residual pressure wave vibrations in the ink channel 613. Two ink droplets are ejected in total in response to a dot print command and coalesce into one dot on a print medium. Because the number of ejection stabilizing pulses is reduced by one as compared to drive waveform 4, the ink droplet ejection volume becomes slightly greater than 30 pl. However, if drive waveform 6 is used to print a dot when the residual pressure wave vibrations in the ink channel 613 are so small that the ink droplet ejection volume will be reduced, the ink droplet ejection volume can be adjusted to 30 pl as required. The above pulse applying timing and pulse widths were obtained from the results of an experiment to ensure stable splash-free ink ejection at temperatures from 5 to 45° C. and at dot printing frequencies from 5 to 8.5 kHz.

Figures 6A, 6B, 6C:
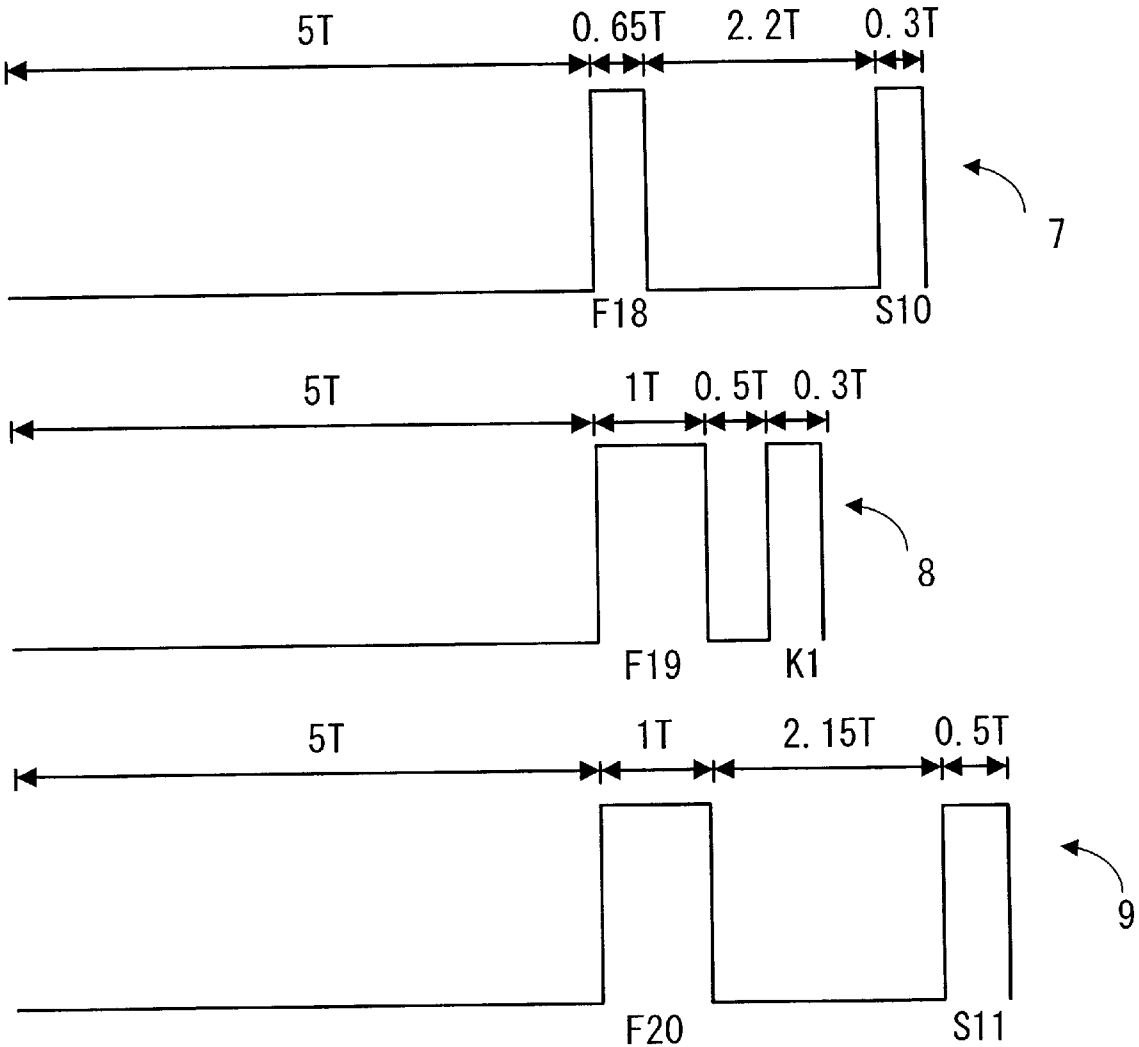
FIGS. 6A through 6C show three drive waveforms for driving the ink jet apparatus to eject a small droplet, according to the embodiment of the invention.

FIGS. 6A through 6C show three ejection pulse signals, each having a different drive waveform for ejecting a small droplet (15 pl). Drive waveform 7 shown in FIG. 6A is a drive waveform for ejecting a small droplet (15 pl) in a normal printing state in which the small droplet is continuously ejected. Each numeric value added to the drive waveform indicates the ratio of a period of time to the one-way propagation time T.

Drive waveform 7, applied in response to a dot print command, includes an ejection pulse F18 for ejecting an ink droplet and an ejection stabilizing pulse S10 for reducing the residual pressure wave vibrations in the ink channel 613. Crest values (voltage values) of all these pulses are E V (for example, 16 V at 25° C.). The width of ejection pulse F18 equals 0.65 times the one-way pressure wave propagation time T, that is, 5.85 μsec. In order to reduce the influence of the residual pressure wave vibrations in the ink channel 613 generated by printing the immediately preceding dot, application of ejection pulse F18 is delayed from the start of a dot printing timed sequence for 5.0 times the one-way pressure wave propagation time T, that is, 45.0 μsec. The width of ejection stabilizing pulse S10 equals 0.3 times the one-way pressure wave propagation time T, that is, 2.7 μsec. A period of time between ejection pulse F18 and ejection stabilizing pulse S10 equals 2.20 times the one-way pressure wave propagation time T, that is, 19.80 μsec.

The ink droplet volume and ejection stability can be controlled using the above-described pulse applying timing and pulse widths. In the case of drive waveform 7 of FIG. 6A, an ink droplet is ejected and then an ejection stabilizing pulse is applied to suppress the residual pressure wave vibrations in the ink channel 613. One ink droplet is ejected in response to a dot print command, and the ink droplet ejection volume is 15 pl as required. The above pulse applying timing and pulse widths were obtained from the results of an experiment to ensure stable splash-free ink ejection when dots are printed continuously at temperatures from 5 to 45° C. and at dot printing frequencies from 5 to 8.5 kHz.

Drive waveform 8, shown in FIG. 6B, is designed to make the ink droplet ejection volume slightly smaller than in the case of drive waveform 7. If drive waveform 8 is used to print a dot when the residual pressure wave vibrations in the ink channel 613 are so great that the ink ejection volume will be increased, the resultant ink droplet ejection volume can be adjusted to about 15 pl. Drive waveform 8 makes the ink droplet ejection volume smaller and, as a result, makes the residual pressure wave vibrations in the ink channel 613 smaller than in the case of drive waveform 7. Thus, if an ink ejection were to occur immediately after a dot was printed using waveform 8 it would be more likely to be affected because of the smaller ink droplet ejection volume and reduced pressure wave variations in the ink channel 613. Therefore, waveform 8 can suppress the pressure wave vibrations remaining ink injection and, if used to print a dot when there is no immediately following dot, can prevent unwanted ink ejection.

Drive waveform 8, applied in response to a dot print command, includes an ejection pulse F19 for ejecting one ink droplet and an ink droplet reducing pulse K1 for reducing the ink droplet produced by ejection pulse F19. Crest values (voltage values) of all these pulses are E V (for example, 16 V at 25° C.). For example, ink droplet reducing pulse K1 is designed to enlarge the ink channel 613 before the ink droplet produced by ejection pulse F19 leaves the nozzle 618 so as to retrieve a portion of the ink droplet into the ink channel 613 and reduce the volume of the ink droplet to be ejected.

The width of ejection pulse F19 equals the one-way pressure wave propagation time T, that is, 9.0 μsec. In order to reduce the influence of the residual pressure wave vibrations in the ink channel 613 generated by printing the immediately preceding dot, application of ejection pulse F19 is delayed after the start of a dot printing timed sequence for 5.0 times the one-way pressure wave propagation time T, that is, 45.0 μsec. The width of ink droplet reducing pulse K1 equals 0.3 times the one-way pressure wave propagation time T, that is, 2.7 μsec. A period of time between ejection pulse F19 and ink droplet reducing pulse K1 equals 0.5 times the one-way pressure wave propagation time T, that is, 4.5 μsec.

The ink droplet volume and ejection stability can be controlled using the above-described pulse applying timing and pulse widths. In the case of drive waveform 8 of FIG. 6B, an ink droplet is ejected and then an ink droplet reducing pulse is applied to retrieve a portion of the ink droplet into the ink channel 613. The resultant volume of an ink droplet ejected in response to a dot print command becomes slightly smaller than 15 pl. However, if drive waveform 8 is used to print a dot when the residual pressure wave vibrations in the ink channel 613 are so great that the ink ejection volume will be increased, the resultant ink droplet ejection volume can be adjusted to 15 pl as required. The above pulse applying timing and pulse widths were obtained from the results of an experiment to ensure stable splash-free ink ejection at temperatures from 5 to 45° C. and at dot printing frequencies from 5 to 8.5 kHz.

Drive waveform 9, shown in FIG. 6C, is designed to make the ink droplet ejection volume slightly greater than in the case of drive waveform 7. If drive waveform 9 is used to print a dot when the residual pressure wave vibrations in the ink channel 613 are so small that the ink ejection volume will be reduced, the resultant ink droplet ejection volume can be adjusted to about 15 pl. If drive waveform 9 were to be used to print a dot continuously from the preceding dot, the residual pressure wave vibrations in the ink channel 613 would be greater than in the case of drive waveform 7 and, as a result, the ink droplet ejection volume would become slightly greater. Thus, drive waveform 9 should be used to print a dot when there is no immediately preceding dot.

Drive waveform 9, applied in response to a dot print command, includes an ejection pulse F20 for ejecting one ink droplet and an ejection stabilizing pulse S11 for reducing the residual pressure wave vibrations in the ink channel 613. Crest values (voltage values) of all these pulses are E V (for example, 16 V at 25° C.). The width of ejection pulse F20 equals the one-way pressure wave propagation time T, that is, 9.0 μsec. In order to reduce the influence of the residual pressure wave vibrations in the ink channel 613 that may exist from previous dot printing timed sequences even though no dot was printed in the immediately preceding dot printing timed sequence, application of ejection pulse F20 is delayed after the start of a dot printing timed sequence for 5.0 times the one-way pressure wave propagation time T, that is, 45.0 μsec. The width of ejection stabilizing pulse S11 equals 0.5 times the one-way pressure wave propagation time T, that is, 4.5 μsec. A period of time between ejection pulse F20 and ejection stabilizing pulse S11 equals 2.15 times the one-way pressure wave propagation time T, that is, 19.35 μsec.

The ink droplet volume and ejection stability can be controlled using the above-described pulse applying timing and pulse widths. In the case of drive waveform 9 of FIG. 6C, an ink droplet is ejected and then an ejection stabilizing pulse is applied to suppress the residual pressure wave vibrations in the ink channel 613. One ink droplet is ejected in response to a dot print command. Because the ejection pulse width and the pulse applying timing are adjusted differently from drive waveform 7, the ink droplet ejection volume becomes slightly greater than 15 pl in volume. However, if drive waveform 9 is used to print a dot when the residual pressure wave vibrations in the ink channel 613 are so limited that the ink ejection volume will be reduced, the ink droplet ejection volume can be adjusted to 15 pl, as required. The above pulse applying timing and pulse widths were obtained from the results of an experiment to ensure stable splash-free ink ejection at temperatures from 5 to 45° C. and at dot printing frequencies from 5 to 8.5 kHz.

The table of FIG. 7 shows, by way of example, which drive waveform should be selected to eject a large droplet (60 pl), depending on the type of ink droplet ejected immediately before and/or after the large droplet to be ejected. When there is ink ejection immediately before the large droplet to be ejected, drive waveform 1 of FIG. 4A is selected, as a general rule, regardless of the type of the preceding or succeeding ink droplet. In this case, however, if there is no ink ejection immediately after the large droplet is to be ejected, drive waveform 2 of FIG. 4B is selected as an exception to the general rule. This is because, when ink ejection ceases after dots are continuously printed, the residual pressure wave vibrations become greatest and may cause ejection of an unwanted ink droplet. Drive waveform 2, which generates less residual pressure wave vibrations, is effective in preventing such accidental ink ejection. When no dot is printed immediately before the large droplet to be ejected, the ink droplet ejection volume is likely to be slightly reduced. Thus, drive waveform 3 of FIG. 4C, which increases the ink droplet ejection volume, is selected.

The table of FIG. 8 shows, by way of example, which drive waveform should be selected to eject a medium droplet (30 pl), depending on the type of ink droplet ejected immediately before and/or after the medium droplet to be ejected. When a large droplet is ejected immediately before the medium droplet to be ejected, the medium droplet is likely to be affected by the residual pressure wave vibrations in the ink channel 613 and increased in volume. Thus, drive waveform 5 of FIG. 5B is selected. When a medium or small droplet is ejected immediately before the medium droplet to be ejected, the medium droplet is less likely to be affected by the residual pressure wave vibrations. Thus, drive waveform 4 of FIG. 5A is selected. In this case, however, if there is no ink ejection immediately after the medium droplet to be ejected, drive waveform 5 of FIG. 5B is selected. This is because, when ink ejection ceases after dots are continuously printed, the residual pressure wave vibrations in the ink channel 613 become greatest and may cause ejection of an unwanted ink droplet. Drive waveform 5, which generates less residual pressure wave vibrations, is effective in preventing such accidental ink ejection. When no dot is printed immediately before the medium droplet to be ejected, the medium droplet is likely to be slightly reduced in volume. Thus, drive waveform 6 of FIG. 5C, which increases the ink droplet ejection volume, is selected.

The table of FIG. 9 shows, by way of example, which drive waveform should be selected to eject a small droplet (15 pl), depending on the type of ink droplet ejected immediately before and/or after the small droplet to be ejected. When a large or medium droplet is ejected immediately before the small droplet to be ejected, the small droplet is likely to be affected by the residual pressure wave vibrations in the ink channel 613 and increased in volume. Thus, drive waveform 8 of FIG. 6B is selected. When a small droplet is ejected immediately before the small droplet to be ejected, the small droplet is less likely to be affected by the residual pressure wave vibrations. Thus, drive waveform 7 of FIG. 6A is selected. In this case, however, if there is no ink ejection immediately after the small droplet to be ejected, drive waveform 8 of FIG. 6B is selected. This is because, when ink ejection ceases after dots are continuously printed, the residual pressure wave vibrations in the ink channel 613 become greatest and may cause ejection of an unwanted ink droplet. Drive waveform 8, which generates less residual pressure wave vibrations, is effective in preventing such accidental ink ejection. When there is no ink ejection immediately before the small droplet to be ejected, the small droplet is likely to be slightly reduced in volume. Thus, drive waveform 9 of FIG. 6C, which increases the ink droplet ejection volume, is selected.

The table of FIG. 10 shows, by way of example, which drive waveform should be selected to print no dot, depending on the type of droplet ejected immediately before and/or after no dot to be printed. When there is no print data, there is no need to eject ink nor select the drive waveform, regardless of whether there is ink ejection immediately before and/or after no dot to be printed.

As described above, by selecting an optimum drive waveform depending on whether there is ink ejection immediately before and/or after a dot to be printed and the type of each droplet ejected before and/or after the dot to be printed, the required volume of ink droplet, that is, a large droplet (60 pl), a medium droplet (30 pl), or a small droplet (15 pl), can be ejected in a stable manner. Accordingly, a high-quality gray-scale image can be produced.

In the above-described embodiment, whether there is ink ejection immediately before and/or after a dot to be printed, that is, whether an adjacent dot is printed immediately before and/or after a dot to be printed, is judged by checking print commands line by line prior to application of ink ejection pulse signals to the actuator. Accordingly, after ink ejection pulse signals having different waveforms for printing each line have been determined, the ink ejection pulses are applied to the actuator.

The ink droplet type is judged by a drive waveform used for ink droplet ejection. Drive waveforms 1–3 constitute a large droplet type, drive waveforms 4–6 constitute a medium droplet type, and drive waveforms 7–9 constitute a small droplet type.

In the above-described embodiment, drive waveforms were previously prepared from the results of experiments. In each experiment, the ink ejecting performance was evaluated by observing printouts with the unaided eye. A loupe or a microscope may be used to perform a more precise evaluation. However, for evaluating printouts produced by an ink jet head of an ink jet apparatus, an unaided visual evaluation is considered to be practically sufficient.

Figure 11:
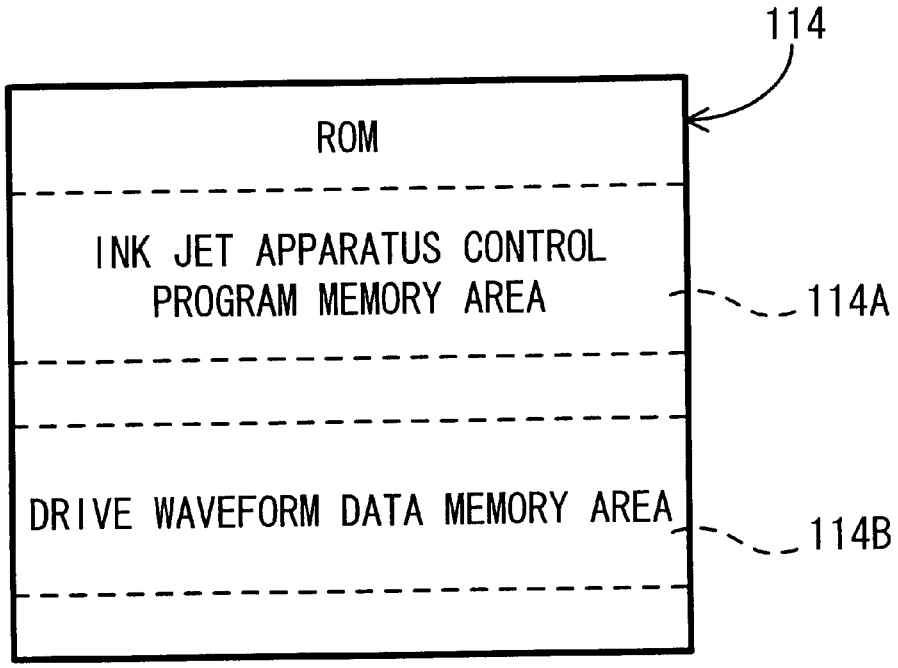
FIG. 11 is a diagram showing memory areas of a ROM of the control circuit of the ink jet apparatus according to the embodiment of the invention.

Referring now to FIGS. 3 and 11, a controller for generating the above-described various drive waveforms, according to the embodiment of the invention, will be described. The controller 625, shown in FIG. 3, includes a charge circuit 182, a discharge circuit 184, and a pulse control circuit 186. Piezoelectric material of the sidewall 617 sandwiched between the electrodes 619, 621 is equivalent to a condenser 191.

Input terminals 181, 183 input pulse signals for applying voltages of E V and 0 V respectively to the electrode 621 in the dummy channel 615. The charge circuit 182 includes resistances R101–R105 and transistors TR101, TR102.

When an ON signal (+5 V) is inputted to the input terminal 181, the transistor TR101 is brought into conduction via the resistance R101, and a current flows from a positive power source 189, via the resistance R103, to a collector and then to an emitter of the transistor TR101. Thus, partial pressure applied to the resistances R104, R105, which are connected to the positive power source 189, increases, and a larger current flows into a base of the transistor TR102. Then, a collector and an emitter of the transistor TR102 is brought into conduction. For example, a voltage of 16 V from the positive power source 189 is applied to the condenser 191, via the collector and the emitter of the transistor TR102, and the resistance R120.

The discharge circuit 184 will now be described. The discharge circuit 184 includes resistances R106, R107 and a transistor TR103. When an ON signal (+5 V) is inputted to the input terminal 183, the transistor TR103 is brought into conduction via the resistance R106. Then the terminal of the condenser 191 on the side of the resistance R120 is grounded via the resistance R120. Thus, a charge applied to the sidewall 617 shown in FIGS. 1 and 2 is discharged.

The pulse control circuit 186, which generates pulse signals to be inputted to the input terminal 181 of the charge circuit 182 and the input terminal 183 of the discharge circuit 184, will now be described. The pulse control circuit 186 is provided with a CPU 110 that performs various computations. Connected to the CPU 110 are a RAM 112 for storing print data and various data and a ROM 114 for storing a control program for the pulse control circuit 186 and sequence data for generating ON/OFF signals at a timed sequence. As shown in FIG. 11, the ROM 114 has an memory area 114A for an ink droplet control program and a memory area 114B for a drive waveform data. Various drive waveform data, shown in FIGS. 4 though 6, is stored in the memory area 114B, and a drive waveform selecting program, shown in FIGS. 7 through 10, is stored in the memory area 114A.

The CPU 110 is connected to an I/O bus 116 for exchanging data. A print data receiving circuit 118 and pulse generators 120, 122 are connected to the I/O bus 116. An output terminal of the pulse generator 120 is connected to the input terminal 181 of the charge circuit 182, and an output terminal of the pulse generator 122 is connected to the input terminal 183 of the discharge circuit 184.

The CPU 110 constitutes, in cooperation with the RAM 112 and the ROM 114, a judging device and an output device. The judging device judges whether a dot is printed immediately before and/or after a dot to be printed and, if so, determines the type of each droplet ejected immediately before and/or after the dot to be printed. The output device selects the drive waveform data, based on the results of the judgement, and outputs the selected drive waveform data from the pulse generators 120, 122.

It should be noted that pulse generators 120, 122, a charge circuit 182, and a discharge circuit 184 are provided for each nozzle. In this embodiment, control of one nozzle is representatively described. Other nozzles are controlled in the same manner.

Figure 12A:
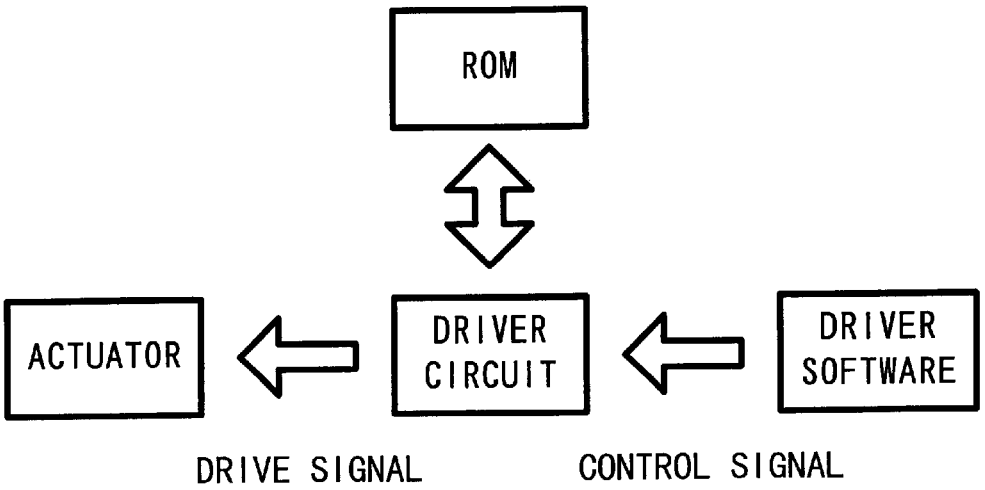
FIGS. 12A and 12B are functional block diagrams showing alternative flows of a print command.
Figure 12B:
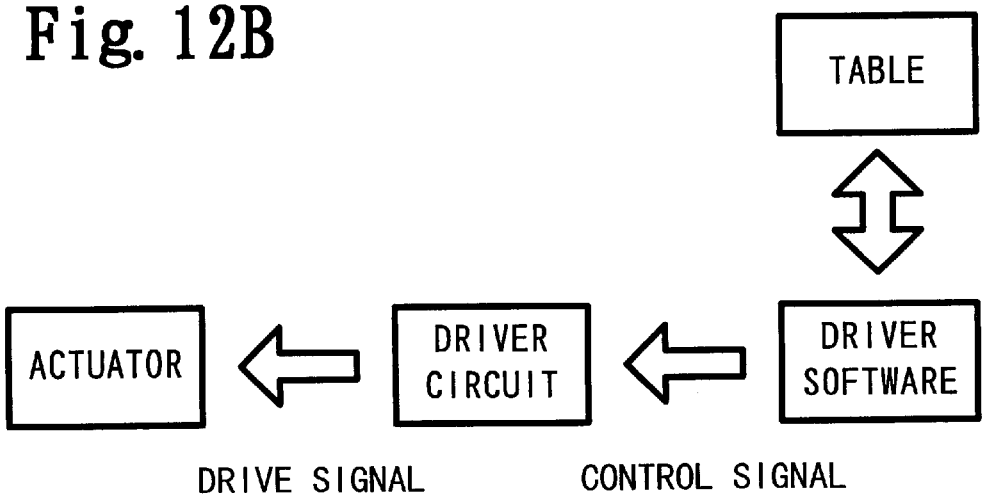

FIGS. 12A and 12B are functional block diagrams showing alternative flows of a print command. In FIG. 12A, a print command is supplied, as a control signal, using driver software installed in a personal computer, or the like, to a driver circuit. Based on the control signal, the driver circuit reads various data from the ROM and generates a drive signal to drive an actuator. The driver circuit judges whether a dot is printed immediately before and/or after a dot to be printed and, if so, determines the type of each droplet ejected immediately before and/or after the dot to be printed. Then the driver circuit adjusts the drive waveform for the dot to be printed, as described above.

In FIG. 12B, a print command is converted to a drive waveform by a personal computer, or the like, using diver software with reference to the tables in FIGS. 7 through 10, and supplied, as a control signal, to the driver circuit. Based on the control signal, the driver circuit generates a drive signal to drive the actuator. In this case, a storage medium for storing the tables in FIGS. 7 though 10 and drive waveform data as well as a program accomplishing the functions of the above-described judging device and output device is provided as driver software.

While the invention has been described in connection with a specific preferred embodiment thereof, it should be understood that the invention is not limited to the above-described embodiment. For example, the ejection pulse, the ink droplet stabilizing pulse, and the ink droplet reducing pulse may be changed in width and number without restraint. Combinations of these pulses may be changed also.

Although, in this embodiment, a shear mode actuator is used, another structure for generating a pressure wave, for example, by distortion of laminated piezoelectric material members in the laminating direction may be used. Materials other than piezoelectric material may be used if they generate a pressure wave in the ink channel.

As described above, according to the invention, the drive waveform for printing a dot is adjusted depending on whether there is ink ejection immediately before and/or after a dot to be printed and the drive waveform used for each ink ejection present immediately before and/or after the dot to be printed. If the invention is applied to gray-scale image printing, an optimum drive waveform can be selected for a dot to be printed according to residual vibrations in the ink channel. As a result, high-quality printing can be achieved without partially unstable dots or undesirable changes in the ink droplet volume.

What is claimed is:

1. A method of driving an ink jet apparatus that comprises a nozzle from which an ink droplet is ejected, an ink channel filled with ink and connected to the nozzle, an actuator that changes a volumetric capacity of the ink channel to generate a pressure wave in the ink channel, and a controller that applies an ejection pulse signal to the actuator to cause ink droplet ejection from the nozzle, the method comprising:

judging whether another dot is present at at least one of immediately before and after a required dot to be formed and, if so, judging a size of the another dot present at the at least one of immediately before and after the required dot to be formed; and adjusting a drive waveform of an ejection pulse signal for forming the required dot based on results of the judging step.

2. The method according to claim 1, wherein a plurality of drive waveforms are previously prepared as ejection pulse signals to be applied to the actuator and, the drive waveform for forming the required dot is adjusted by selecting one of the plurality of drive waveforms, based on the results of the judging step.

3. The method according to claim 2, wherein the ejection pulse signals are classified into groups by ink droplet ejection volume, each group including a plurality of ejection pulse signals having different drive waveforms, and wherein the drive waveform for forming the required dot is adjusted by selecting an ejection pulse signal having a predetermined drive waveform from among the plurality of ejection pulse signals that are classified under a group designated for the required dot to be formed.

4. The method according to claim 1, wherein the judging step judges whether a first dot is present immediately before the dot to be formed and whether a second dot is present immediately after the required dot to be formed, and when the judging step judges the first dot is present immediately before the required dot to be formed and the second dot is not present immediately after the required dot to be formed, the adjusting step adjusts the drive waveform to make the actuator cause ink droplet ejection with a smaller ejection volume than that of ink droplet ejection caused by the actuator when the second dot is present immediately after the required dot to be formed.

5. The method according to claim 1, wherein the judging step judges whether a first dot is present immediately before the required dot to be formed and whether a second dot is present immediately after the dot to be formed, and when the judging step judges the first dot is not present immediately before the required dot to be formed, the adjusting step adjusts the drive waveform to make the actuator to cause ink droplet ejection with a larger ejection volume than that of ink droplet ejection caused by the actuator when the first dot is present immediately before the required dot to be formed.

6. The method according to claim 1, further comprising assigning an ejection pulse signal to a second dot immediately after the required dot to be formed, corresponding to a selected waveform, wherein the judging a size of the another dot is present at the at least one of immediately before and after the required dot to be formed is performed by judging at least one of the ejection pulse signal adjusted by the adjusting step for a first dot present immediately before the required dot to be formed and the ejection pulse signal assigned by the assigning step to the second dot present immediately after the required dot to be formed.

7. The method according to claim 1, wherein the controller applies the ejection pulse signal according to a print command, and the judging step is executed on the basis of the print command which includes information whether a required dot is to be formed and information on a size of the required dot to be formed.

8. A method of driving an inkjet apparatus that comprises a nozzle from which an ink droplet is ejected, an ink channel filled with ink and connected to the nozzle, an actuator that changes a volumetric capacity of the ink channel to generate a pressure wave in the ink channel, and a controller that applies an ejection pulse signal to the actuator to cause ink droplet ejection from the nozzle, the method comprising:

judging whether another dot is present at at least one of immediately before and after a required dot to be formed and, if so, judging a volume of ink droplet ejected to create the another dot present at the at least one of immediately before or after the required dot to be formed; and adjusting a drive waveform of an ejection pulse signal for forming the required dot based,on results of the judging step.

9. An ink jet apparatus, comprising:

a nozzle from which an ink droplet is ejected;

an ink channel filled with ink and connected to the nozzle;

an actuator that changes a volumetric capacity of the ink channel to generate a pressure wave in the ink channel; and a controller that applies an ejection pulse signal to the actuator to cause ink droplet ejection from the nozzle, the controller comprising:

a judging device that judges whether another dot is present at at least one of immediately before and after a required dot to be formed and, if so, judges a dot size of the another dot present at the at least one of immediately before and after the required dot to be formed; and an output device that adjusts a drive waveform for forming the required dot based on results of judgment by the judging device and outputs the adjusted drive waveform as an ejection pulse signal.

10. The ink jet apparatus according to claim 9, wherein the controller further comprises a memory for storing a plurality of ejection pulse signals having different drive waveforms, and wherein the output device outputs the adjusted drive waveform by selecting an ejection pulse signal from among the plurality of ejection pulse signals stored in the memory device.

11. The ink jet apparatus according to claim 10, wherein the memory stores the plurality of ejection pulse signals that are classified into groups by ink droplet ejection volume, each group including a plurality of ejection pulse signals having different drive waveforms, and wherein the output device selects an ejection pulse signal having a predetermined drive waveform from among the plurality of ejection pulse signals that are classified under a group designated for the required dot to be formed.

12. The ink jet apparatus according to claim 9, further comprising an assignment device for assigning an ejection pulse signal corresponding to a selected waveform to a second dot after the required dot to be formed, wherein the judging device uses at least one of an ejection pulse signal of a first dot immediately before and the assigned ejection pulse signal of the second dot after the required dot to be formed in judging the required dot size.

13. A storage medium for storing a program for outputting an ejection pulse signal to an actuator of an ink jet apparatus so that the actuator changes a volumetric capacity of an ink channel filled with ink and connected to a nozzle to generate a pressure wave in the ink channel and cause ink droplet ejection from the nozzle, the program accomplishing the functions of:

judging whether another dot is present at at least one of immediately before and after a required dot to be formed and, if so, judging a size of the another dot present at the at least one of immediately before and after the required dot to be formed; and adjusting a drive waveform of an ejection pulse signal for forming the required dot based on results of judgment and outputting the adjusted drive waveform.

14. The storage medium according to claim 13, program further accomplishes the function of generating a plurality of ejection pulse signals having different drive waveforms, the adjusted drive waveform being outputted by selecting an ejection pulse signal from among the plurality of ejection pulse signals.

15. The storage medium according to claim 14, wherein the plurality of ejection pulse signals are classified into groups by ink droplet ejection volume, each group including a plurality of ejection pulse signals having different drive waveforms, and wherein an ejection pulse signal having a predetermined drive waveform is selected from among the plurality of ejection pulse signals that are classified under a group designated for the required dot to be formed.

16. An ink droplet ejecting apparatus for printing grayscale images, comprising:

a printhead having a plurality of ink ejection channels and associated nozzles for ejecting ink based on a volumetric change in an ejecting ink channel;

an activation circuit that controls the volumetric change in the ejecting ink channel; and a controller that determines an ejection waveform to be used and provides activation instructions to the activation circuit on a basis of a size of a required dot and whether another dot is present at at least one of immediately before and immediately after the required dot.

17. The apparatus according to claim 16, further comprising a memory, the memory storing an ejection waveform for continuous required dot printing, required dot printing with no immediately preceding dot, and required dot printing with no immediately following dot for at least three sizes of dots.

18. The apparatus according to claim 17, wherein the controller includes a determination element that determines whether a first dot is present before the required dot, a second dot is present after the required dot, and the required dot is part of a continuous printing of dots and selects the appropriate ejection waveform.

19. The apparatus according to claim 18, wherein the determination element determines whether the first dot is present immediately before the required dot and whether the second dot is present immediately after the required dot, and when the determination element determines the first dot is present immediately before the required dot and the second dot is not present immediately after the required dot, the controller selects the ejection waveform to make the activation circuit cause ink droplet ejection with a smaller ejection volume than that of ink droplet ejection caused by the activation circuit when the second dot is present immediately after the required dot.

20. The apparatus according to claim 18, wherein the determination element determines whether the first dot is present immediately before the required dot and whether the second dot is present immediately after the required dot, and when the determination element determines the first dot is not present immediately before the required dot, the controller selects the ejection waveform to make the activation circuit cause an ink droplet ejection with a larger ejection volume that that of ink droplet ejection caused by the activation circuit when the first dot is present immediately before the required dot.

* * * * *